United States Patent [19]

Hartig et al.

[11] 3,981,131

[45] Sept. 21, 1976

[54] HIGH SPEED TWISTING MACHINE

[75] Inventors: Wolfgang Hartig, Remscheid; Dietrich Berges, Marienheide; Heinz Schippers, Remscheid, all of Germany

[73] Assignee: Barmag Barmer Maschinenfabrik Aktiengesellschaft, Wuppertal, Germany

[22] Filed: Feb. 11, 1975

[21] Appl. No.: 548,982

[30] Foreign Application Priority Data

Feb. 16, 1974 Germany ..... 2407473

[52] U.S. Cl. ..... 57/58.54; 57/58.63; 57/58.83

[51] Int. Cl.[2] ..... D01H 1/10

[58] Field of Search ..... 57/58.3–58.38, 57/58.49–58.55, 58.63, 58.7, 58.83, 156, 166

[56] References Cited

UNITED STATES PATENTS

| | | | |
|---|---|---|---|
| 1,263,405 | 4/1918 | Groudahl | 57/58.49 X |
| 3,613,348 | 10/1971 | Costa | 57/58.32 X |
| 3,726,074 | 4/1973 | Peene | 57/58.36 X |
| 3,830,050 | 8/1974 | Veda | 57/58.34 |

*Primary Examiner*—Richard C. Queisser
*Assistant Examiner*—Charles Gorenstein
*Attorney, Agent, or Firm*—Johnston, Keil, Thompson & Shurtleff

[57] ABSTRACT

A high-speed wire twisting machine with feed spools in cradle-type carriers rockingly mounted between paired rotors which have hollow axial passages and are aligned at spaced intervals on the twisting axis, each spool carrier being provided with deflection means to guide the wires, as they are initially drawn off and plied through the axis of the rotors in a forward direction, around each cradled feed spool, and the last rotor at the front end of the machine being provided with a guide over which the plied wires are drawn off and deflected outwardly to be returned to a rear outlet end of the machine, especially with a two-for-one twisting with the plied wires forming individual balloons between each pair of rotors. Twist stop means are preferably mounted in the front carrier which contains a feed spool or for special purposes a wire treatment means in place of the feed spool.

9 Claims, 2 Drawing Figures

HIGH SPEED TWISTING MACHINE

Figure 1:
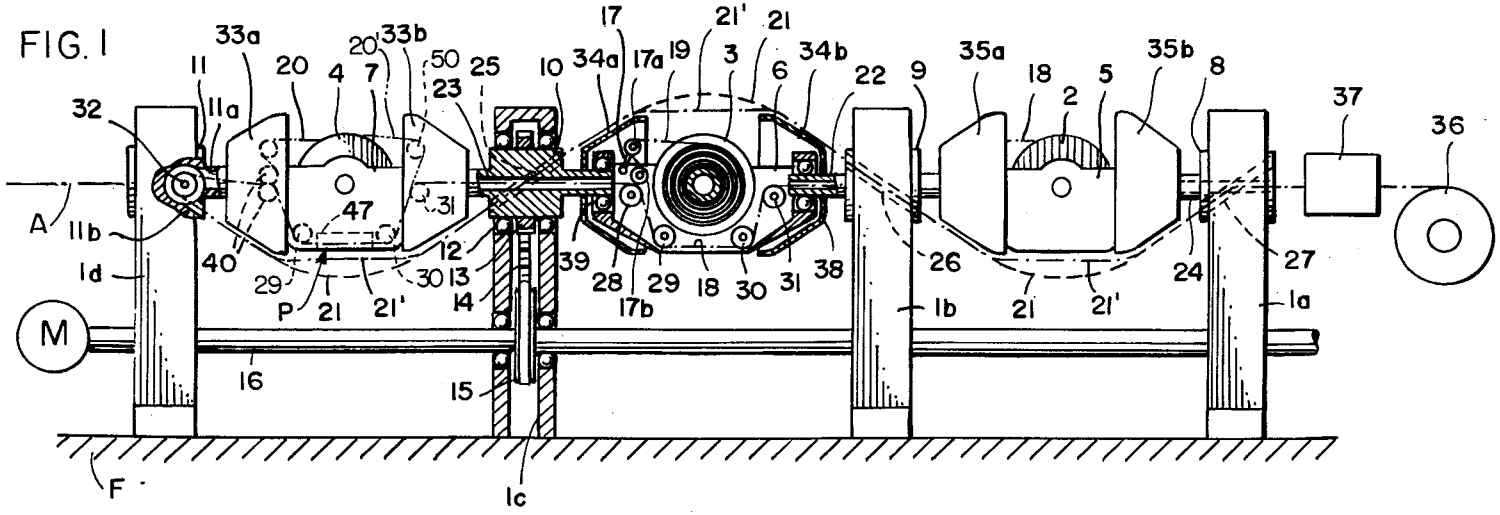

High-speed twisting machines of one specific type are known, for example as disclosed in German Published Patent Specification (DT-OS) No. 2,164,131, or in Swiss Pat. (CH-PS) No. 494,857, these machines consisting of individual rotors with an arrangement of the spool carriers, feed spools and guides described hereinafter in greater detail as the setting or generally known combination of apparatus wherein an improvement is to be provided in accordance with the present invention. The wires in these twisting machines, are guided sinusoidally around the spool holders and feed spools situated along the twisting axis in the direction of wire travel. The wires either balloon-freely (DT-OS No. 2,164,131) or are conducted over guide bows or curved members which are fixed to a guide frame or housing and bridge the gap between two adjacent rotors (CH-PS No. 494,857). At the rear or take-off end of the machine, the wires being run off are guided into a stranding head and twisted. Before being wound into a package, the wires may pass through further units for preforming the wires and through aligning units in which the individual wires are aligned and made twist-free. In this type of twisting or stranding machine, the individual wires are wound around one another only once for every revolution completed by the rotor.

Rotor twisting machines are known in which several feed spools are arranged one behind the other and which function on the two-for-one twisting principle such that, for each revolution completed by the rotor as a whole, substantially two twists or turns are introduced into the bundle of wires. See, for example, German Published Patent Specifications (DT-OS) Nos. 1,510,160 and 2,115,313; or German Laid-open Specification (DT-AS) No. 2,027,081. The feed spools in these machines are arranged one behind and/or alongside one another in the rotor. Proceeding from the individual feed spools, the wires are first guided together through the rotor shaft to one end of the machine where they are plied. The wires are then diverted through an angle of substantially 360° and guided internally or externally on the rotor to the opposite end of the machine where they are wound into packages. In this type of machine, a double twist is formed for each revolution completed by the rotor.

The disadvantage of this double twist or so-called "two-for-one" twisting machine is that a very large balloon must be formed, encompassing all of the feed spools in terms of overall width and length. The forces exerted on this balloon are very high. In addition, this machine is extremely difficult to service.

One of the objects of the present invention is to obviate the disadvantages of known high-speed twisting machines and to provide a high-speed twisting machine which functions on the two-for-one twisting principle and in which the balloon forces occurring are only minimal and can be withstood by the material being twisted without damage and without any adverse effect upon the final product. Another object of the invention is to modify the high-speed twisting machine of the first type discussed above in such a manner that it may also function on the two-for-one twisting principle, a result which was not previously possible.

Figure 2:
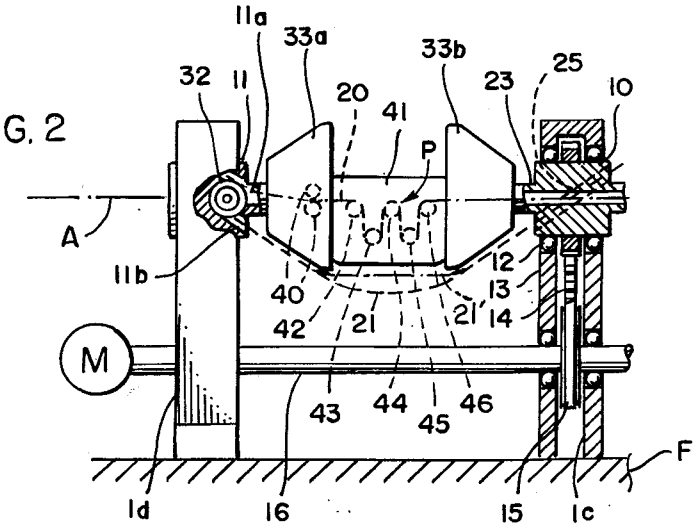

These and other objects and advantages are achieved by the invention as set forth in the following detailed specification taken with the accompanying drawing in which:

FIG. 1 is a side elevational view, partly in cross-section, of one embodiment of the improved multi-rotor twisting machine of this invention; and FIG. 2 is a similar view of the machine shown in FIG. 1 but illustrating only the machine position between the front or left-hand pair of rotors where a feed spool is replaced by a wire treating device.

The present invention as illustrated in these drawings and described in detail hereinafter is essentially an improvement in the generally known combination of apparatus which comprises:

a. a plurality of individual rotors which are arranged in alignment one behind the other, which are driven at the same rotational speed and which contain guides for wires linearly intersecting the common twisting axis of the rotors;

b. a plurality of spool carriers which are rockingly mounted between two individual rotors;

c. feed spools on which wire is stored, each spool being mounted for rotation in one of the spool carriers;

d. guide means which are connected cantilever-fashion to the individual rotors and which serve to guide the wire arriving at the rear outlet end of the machine from the front end thereof around the spool carriers and feed spools situated in the rearward direction of wire travel; and e. a winding means at the outlet end of the machine to take up the plied and twisted wires.

The improved machine, which may be used for two-for-one twisting in accordance with the invention, comprises rotors having hollow axial passages, spool carriers having deflection means for guiding the wires which are initially forwardly drawn off through the axis of the rotors so as to pass said wires around each feed spool in the forward take-off direction, and a guide means mounted in the last rotor at the front end of the machine for drawing off the wires forwardly through the axis of the rotors and for collecting the wires into a bundle directed outwardly to be returned to the rear outlet end of the machine while forming individual balloons between each two adjacent rotors.

In one preferred embodiment, a wire treatment means or mechanism is mounted in a cradled or rockingly supported carrier at the front end of the machine between two rotors in place of or in front of the feed spools and on the same twisting axis.

In addition, it is preferable to provide a twist stopper, e.g. using nip rolls or the like, mounted in the most forward feed spool carrier or in the carrier which holds a wire treatment means.

Referring now to both FIGS. 1 and 2 of the drawing, the two-for-one twisting machine of the invention in terms of its general structure substantially corresponds to the exemplary embodiment illustrated in copending application Ser. No. 542,198, filed Jan. 20, 1975, by Berges et al. The completely hollow axial passage in the rotor or bearing tube of this copending case was borrowed from the present application and does not arise from the original disclosure of Berges et al who require only a partially hollow rotor or bearing tube.

The hollow axial passages of the rotors thus constitutes an essential and distinguishing feature of the present invention as one modification of the machine disclosed in said copending application, the disclosure of which is otherwise incorporated herein by reference.

In the present invention, the machine blocks or supports 1*a*, 1*b*, 1*c* and 1*d* are firmly mounted to the floor or base frame F, and each of these support members has a rotor 8, 9, 10 and 11, respectively, rotatably mounted by means of the bearings 12 around the common rotor or twisting axis A. The rotors are driven at the same constant speed by the central drive shaft 16 through pulley wheels 13 and 15 and the transmission belt 14. These drive means are shown in cross-sectional detail in FIG. 1 as associated with the machine support 1*c*, the drive shaft 16 being operated by a suitable motor M shown schematically at the left or front end of the machine.

The spool carriers 5, 6 and 7 are rockingly or swingably mounted in cradle fashion on the bearings 38 and 39 which in turn are carried on the oppositely facing tubular axial extensions of the rotors 9 and 10, again as shown in FIG. 1. The feed spools 2, 3 and 4 are mounted for rotation in the spool carriers. The feed spools can be decelerated by a dancer arm 17 and a brake means (not shown but see DT-OS No. 1,808,120.)

The individual rotors in FIG. 1 contain the guide pots: 33*a*, 33*b*; 34*a*, 34*b* and 35*a*, 35*b*. The object of these outer guide pots in paired opposition is to direct a wire guided over their surface around the spool carrier with its feed spool arranged between each two guide pots, even when the machine is only rotating at a low speed. The pots 33*b* and 34*a* are connected by their bases or flanges to the rotor 10 so as to rotate around the twisting axis and provide at least some torque to the rotating "balloon" of the wire 21. At low wire twisting speeds, the path of wire 21 conforms most closely to the outer wire-contacting surface of the two facing pots as indicated by the long and short dashed line 21′ while the evenly dashed line 21 describes the path of the wire as it ballons outwardly at higher twisting speeds.

Each spool carrier contains the guide rollers 28, 29, 30 and 31 as shown on spool carrier 6 of FIG. 1, each roller being mounted on a transverse axis of rotation with respect to the twisting axis A and preferably being positioned in a common plane passing vertically through this twisting axis. Where the carrier 6 is constructed as a box or cradle with four vertical side walls, the shafts or pins supporting the rotatable guide rollers 28, 29, 30 and 31 are easily fastened to one or both side walls extending in the axial direction of the machine. Likewise, the dancer arm 17 and its associated guide rolls 17*a* and 17*b* may also be mounted to the carrier side walls in the same manner on transverse pins or shafts.

The object of these carrier mounted guide rollers is to conduct a wire in a deflected path around the feed spool mounted in the spool holder.

As disclosed in the above noted Berges et al. application and elsewhere in the prior art, the rotors further contain diagonally transverse passages 25, 26 and 27 which cross over the rotor or twisting axis A at a short distance from radially of this axis to avoid interfering with the single or plied wires being conducted down the twisting axis through each intermediate rotor.

The difference between the present improved embodiments of a two-for-one twisting machine and that which is illustrated in said copending Berges et al application, as well as the prior art, will become more apparent from the following description of the mode of operation of the machine shown in FIGS. 1 and 2.

Issuing from their feed spools 2, 3 and 4, the wires 18, 19 and 20 are immediately drawn over the dancer arm roller 17*a* and roller 17*b* into the rotors 9, 10 and 11 respectively following the individual feed spools. The wires are then drawn off forwardly through the axial passages 22 and 23, as indicated in rotors 9 and 10 of FIG. 1, to pass into the next spool carrier. Here the wires are deflected via rollers 28, 29, 30 and 31 to pass around the next succeeding feed spool 3 or 4 so as to be guided together with the wire 19 or 20 coming from the passed spool through the center or axial passage of the next rotor.

Accordingly, as shown in the spool carrier 6, the wire 18 coming from the feed spool 2 is passed via the rollers 28, 29, 30 and 31 around the feed spool 3 and then plied with the wire 19 coming from spool 3 and guided into the axial passage 23 of the next rotor 10. This bundle or group of wires 18 and 19 then enters the spool carrier 7 where it is again passed around a feed spool 4 by the same type of guide roller assembly and or plied with the newly fed wire 20.

The rotor 11 contains an internal guide roller 32 mounted for free rotation on a transverse axis or shaft which is fixed to the rotor so that the roller 32 also rotates end for end in a plane transverse to the twist axis A. The bundle 21 consisting of the wires 18, 19 and 20 is drawn around this guide roller 32, first entering through the rotor passageway 11a and then exiting through the reverse angled passageway 11*b* toward the first guide pot 33*a* to start the multi-balloon path in the rearward travel of the plied wires. The bundle of plied wires 21 is then traveled over the pots 33*a*, 33*b* through the transverse passage 25 of rotor 10, then over the pots 34*a*, 34*b* through the transverse passage 26, next over the pots 35*a*, 35*b* through the transverse passage 27 and, finally, at the end of the machine, is wound up onto the reel or take-up roll 36. In operation and especially during high-speed twisting, the bundle of wires 21 forms individual balloons around the spool carriers and their feed spools arranged in the direction of reverse wire travel i.e. in the order of the spool carriers 7 to 6 to 5.

It is pointed out that any suitable twist arresting means, for example twist stoppers such as nip rolls 40, may be arranged in the last spool carrier 7 as shown in FIG. 1 to prevent the twist from running back too far into this spool carrier. The two nip rolls 40 can be mounted in the carrier 7 in place of the guide rollers 28 as shown in the spool carrier 6.

As illustrated in FIG. 2, when the last spool carrier 41 is adapted to provide wire treatment means of one kind or another, then the nip rolls 40 may be positioned at the left-hand or front end of the carrier 41 to prevent the twist from extending back to the wire-contacting rollers 42, 43, 44, 45, 46 which function as a braking mechanism or which may also be arranged in other wire treatment configurations, using fewer or even more rollers, pins or the like. On the other hand, the nip rolls 40 may be mounted at the right-hand or back end of carrier 41 so that the twist will not extend backwardly through the rotor 10 to the preceding carrier 6 (FIG. 1).

The guide or reversing roller 32 in rotor 11 may be replaced by any other form of guide which, according to the illustrated embodiment of the invention, is preferably in the form of an aligning unit. Suitable assemblies of aligning units of this kind are well known in the literature, for example as disclosed in the German patent specification (DT-PS) No. 582,358.

In addition, conventional types of wire preforming units P may be arranged in the last spool carrier 7 at 47 as shown in FIG. 1 or in the carrier 41 as shown in FIG. 2 at the front end of the machine, which is taken here as being opposite the take-off end adjacent the winding means 36. The mode of operation and specific construction of preforming units of this kind are described in detail in the prior art, for example in U.S. Pat. No. 3,641,755 which is incorporated herein by reference as fully as if set forth in its entirety. The object of the known aligning and preforming units is to preform the wire before the first twist is introduced and also to align the first twist introduced.

In addition, conventional cable or strand treating or processing means 37 may also be present at the rear end of the machine. These strand treating or processing means may be conventional aligning and straightening units by which the strand or bundle of wires with a double twist is straightened out and made more uniform as a final twisted product. False twisters may also be incorporated by which the initially machine twisted bundle or strand of wires is made twist-free (cf. as shown for example in U.S. Pat. No. 3,641,755).

The particular advantage of the improvement in a twisting machine provided by the invention is that one can adopt high-speed twisting features of the first type of machine referred to above in connection with DT-OS No. 2,164,131, CH-PS No. 494,857 and the copending application of Berges et al., and this machine can then be operated either on the simple twisting principle or on the two-for-one twisting principle with only relatively slight modifications. The method preferably followed in a two-for-one twisting process is that disclosed in copending application Ser. No. 549,089, filed Feb. 11, 1975, by Hartig et al. This method is therefore incorporated herein by reference as fully as if set forth in its entirety.

Another advantage of the invention resides in the fact that each carrier member 5, 6, 7 and 41 is operated as an independent freely oscillating or rocking unit in the nature of a cradle between each pair of oppositely disposed rotors. One can add on as many feed spools as are needed in sequence and one or more wire treating means can be included, not only at the forward end of the machine but even between sequential feed spools. This permits a high degree of flexibility in the kinds of wire twisting and treating or processing which can be carried out on the same basic machine. Thus, in addition to preforming devices or aligning units, one may also introduce false twisting units or assemblies as commonly required for textile filaments or yarns.

Each carrier 5, 6, 7 and 41 may be weighted below the axis of rotation A so as to provide a low center of gravity which keeps these carriers practically stationary even when the rotors are run at high speed. This weight is provided at least in part by the various guide rollers or similar wire contacting means 28, 29, 30, 31 or 42, 43, 44, 45, 46 or 47 which fall beneath the axis A.

Another problem solved by the present invention is the establishment of a definite twisting point where the high-speed twisting machine is operated on the two-for-one twisting principle. In most instances, it is preferable to have a twist stop means associated with the last carrier at the front or forward end of the machine, such as the illustrated nip rolls 40 just preceding the reverse guide or deflecting means 32.

In addition, it is especially advantageous to provide suitable strand processing means for straightening a wire cable or strand and to free it from twist, even in the absence of tension. Such strand processing means which are known per se may be inserted before as well as after the first twist has been introduced by the machine.

In order to maintain all of the plied wires parallel over a sufficiently long distance when the feed wire 20 of the last spool carrier 7 is joined with at least one preceding wire 18, 19 to form a bundle of wires for subsequent twist stopping and/or wire preforming, it is preferable to provide twist stop means and/or wire preforming means mounted on or associated with said last spool carrier, and a feed guide means such as roll 50 shown in FIG. 1 as an alternative to the forward draw off of wire 20. In this instance, wire 20° is drawn off in the direction toward the rear of the machine around the feed quick roll 50 and is then conducted or passed to a point where this feed wire 20' is joined with the preceding wires 18, 19, for example at the first deflecting roll 31 of the last spool carrier 7. The deflecting rolls 29, 30, 31 then pass the resulting bundle of wires in parallel around the last spool carrier 7 and through twist stop means such as nip rolls 40. The embodiment of FIG. 2 may also be incorporated with the last spool carrier 7 by arranging deflecting or wire treatment means 47 similar to rolls 42, 43, 44, 45, 46 on the carrier 7 in a path below and around the feed spool 4, i.e. in place of the rolls 29 and 30 of carrier 7, the roll 46 of FIG. 2 becoming the roll 31 of FIG. 1. This reverse and then forward feed winding permits the feed wire of the final or last feed spool in the series to run for the added distance from roll 31 to nip rolls 40 while also preferably introducing twist stopping and/or wire preforming means P over this distance.

It is pointed out that the high-speed twisting machine according to the invention can also be used for twisting tapes, ribbons, cords, ropes, filaments, threads, yarns or any similar strandable material which can be furnished in a continuous length from a suitable feed spool. The term "wire" is thus used herein to refer broadly to any individual filament, thread, metallic wire, yarn or the like which can be easily handled on the machine whether one desires to obtain a twisted or untwisted product. Such wires may thus be composed of metal, glass, natural fibers in the form of threads or yarns, or any of the well known synthetic mono- or multi-filamentary polymers such as nylon, polyethylene terephthalate, polyolefins or the like.

The term "strand" as used in this application refers to the bundle of plied wires or filaments after they have been joined together in the machine from different feed spools.

It is also possible, in accordance with the invention, to arrange several high-speed twisting machines one behind the other to serve as strand-twisting units and to obtain a wire cable made up of a number of individual twisted strands at the end of the whole arrangement. Such wire cables may be formed around a core wire or strand, or they may be formed of a number of strands twisted by a final stranding die without any core wire or strand. These and other variations or applications of the twisting machine of the invention will be readily apparent to those skilled in this art and will serve to demonstrate the versatility and adaptability of the machine.

The invention is hereby claimed as follows:

1. In a high-speed twisting machine including (a) a plurality of individual rotors which are arranged in alignment one behind the other, which are driven at the same rotational speed and which contain guides for wires linearly intersecting the common twisting axis of the rotors, (b) a plurality of spool carriers which are rockingly mounted between two individual rotors, (c) feed spools on which wire is stored, each spool being mounted for rotation in one of the spool carriers, (d) guide means which are connected for outward extension from the individual rotors and which serve to guide the wire arriving at the rear outlet end of the machine from the front end thereof around the spool carriers and feed spools situated in the rearward direction of wire travel and (e) a winding means at the outlet end of the machine to take-up the plied and twisted wires, the improved combination in said machine for two-for-one twisting which comprises:

rotors having hollow axial passages; and spool carriers having deflection means for guiding the wires which are initially forwardly drawn off through the axis of the rotors so as to pass said wires around each feed spool in the forward take-off direction, the last rotor at the front end of the machine having a guide over which the wires after being drawn off forwardly through the axis of the rotors and collected into a bundle are deflected outwardly to be returned to the rear outlet end of the machine while forming individual balloons between each two adjacent rotors.

2. A high-speed twisting machine as claimed in claim 1 wherein a twist stop means is associated with the last spool carrier at the front end of the machine.

3. A high-speed twisting machine as claimed in claim 1 wherein a wire preforming means is mounted in the last rotor at the front end of the machine.

4. A high-speed twisting machine as claimed in claim 1 wherein strand processing means are arranged is a separate carrier member rockingly mounted between the last rotor at the front end of the machine and the next adjacent rotor of a spool carrier.

5. A high-speed twisting machine as claimed in claim 1 wherein strand processing means are arranged at the rear outlet end of the machine where the twisted strand is withdrawn by a winding means.

6. A high-speed twisting machine as claimed in claim 1 wherein a wire treating means is mounted in a freely rocking carrier between the last two rotors at the front end of said machine.

7. A high speed twisting machine as claimed in claim 1 including a twist stop means associated with the last spool carrier at the front end of the machine, and feed guide means on said last spool carrier to draw off the wire from the feed spool carried thereon such that the wire first passes in a direction toward the rear end of the machine and then to a point where this wire is joined with at least one preceding wire for passage of the resulting bundle of wires around said last spool carrier and through said twist stop means.

8. A high speed twisting machine as claimed in claim 1 including a wire preforming means associated with the last spool carrier at the front end of the machine, and feed guide means on said last spool carrier to draw off the wire from the feed spool carried thereon such that the wire first passes in a direction toward the rear end of the machine and then to a point where this wire is joined with at least one preceding wire for passage of the resulting bundle of wires around said last spool carrier and through said wire preforming means.

9. A high speed twisting machine as claimed in claim 1 including a twist stop means and a wire preforming means associated with the last spool carrier at the front end of the machine, and feed guide means on said last spool carrier to draw off the wire from the feed spool carried thereon such that the wire first passes in a direction toward the rear end of the machine and then to a point where this wire is joined with at least one preceding wire for passage of the resulting bundle of wires around said last spool carrier and sequentially through said twist stop means and said wire preforming means.

* * * * *

UNITED STATES PATENT AND TRADEMARK OFFICE

CERTIFICATE OF CORRECTION

PATENT NO. : 3,981,131

DATED : September 21, 1976

INVENTOR(S) : HARTIG et al

It is certified that error appears in the above-identified patent and that said Letters Patent are hereby corrected as shown below:

In Column 7, Line 38, delete " ... arranged is a ... " and substitute -- ... arranged in a ... --

Signed and Sealed this

*Twenty-ninth* Day of *November 1977*

[SEAL]

*Attest:*

RUTH C. MASON
*Attesting Officer*

LUTRELLE F. PARKER
*Acting Commissioner of Patents and Trademarks*